United States Patent [19]

Plunkett et al.

[11] Patent Number: 4,544,570

[45] Date of Patent: Oct. 1, 1985

[54] ELECTROSTATIC HIGH VOLTAGE ISOLATION SYSTEM WITH INTERNAL CHARGE GENERATION

[75] Inventors: Robert T. Plunkett; Ion I. Inculet, both of London, Canada

[73] Assignee: Nordson Corporation, Amherst, Ohio

[21] Appl. No.: 574,286

[22] Filed: Jan. 26, 1984

[51] Int. Cl.[4] ..... B05D 1/04; B05B 5/02

[52] U.S. Cl. ..... 427/27; 118/621; 239/3; 239/690; 239/691

[58] Field of Search ..... 427/27; 118/621, 627; 239/3, 690, 691, 704–708

[56] References Cited

U.S. PATENT DOCUMENTS

| | | | |
|---|---|---|---|
| 2,673,232 | 3/1954 | Silsby, Jr. | 174/15 |
| 3,098,890 | 7/1963 | Peterson | 174/5 |
| 3,122,320 | 2/1964 | Beck et al. | 239/3 |
| 3,360,035 | 12/1957 | Van Loo et al. | 165/105 |
| 3,769,627 | 10/1973 | Stone . | |
| 3,892,357 | 7/1975 | Tamny . | |
| 3,893,620 | 7/1975 | Rokadia . | |
| 3,915,113 | 10/1975 | Paton | 118/625 |
| 3,929,286 | 12/1975 | Hastings et al. . | |
| 3,933,285 | 1/1976 | Wiggins . | |
| 3,934,055 | 1/1976 | Tamny . | |
| 3,971,337 | 7/1976 | Hastings . | |
| 4,017,029 | 4/1977 | Walberg . | |
| 4,020,866 | 5/1977 | Wiggins . | |
| 4,077,227 | 3/1978 | Larson . | |
| 4,085,892 | 4/1978 | Dalton . | |
| 4,097,680 | 6/1978 | Clavell, Jr. . | |
| 4,204,844 | 5/1980 | Pilat . | |

*Primary Examiner*—Richard Bueker

*Attorney, Agent, or Firm*—Wood, Herron & Evans

[57] ABSTRACT

An electrostatic high voltage isolation system with internal charge generation in which conductive coating material to be sprayed is electrostatically charged by charging discrete droplets of coating material transferred from a coating material source to a supply of coating material for a spray gun. The source of coating material includes an electrically grounded reservoir of coating material having a nozzle aperture in a bottom portion thereof, and the coating material in the reservoir is mechanically vibrated to produce a pulsed jet droplet flow of coating material from the nozzle into a supply container for the spray gun. A high voltage electrode at the location of droplet formation induces an electrostatic charge on the droplets in order to electrostatically charge the coating material transferred to the gun supply container for use by the gun for electrostatic coating.

7 Claims, 1 Drawing Figure

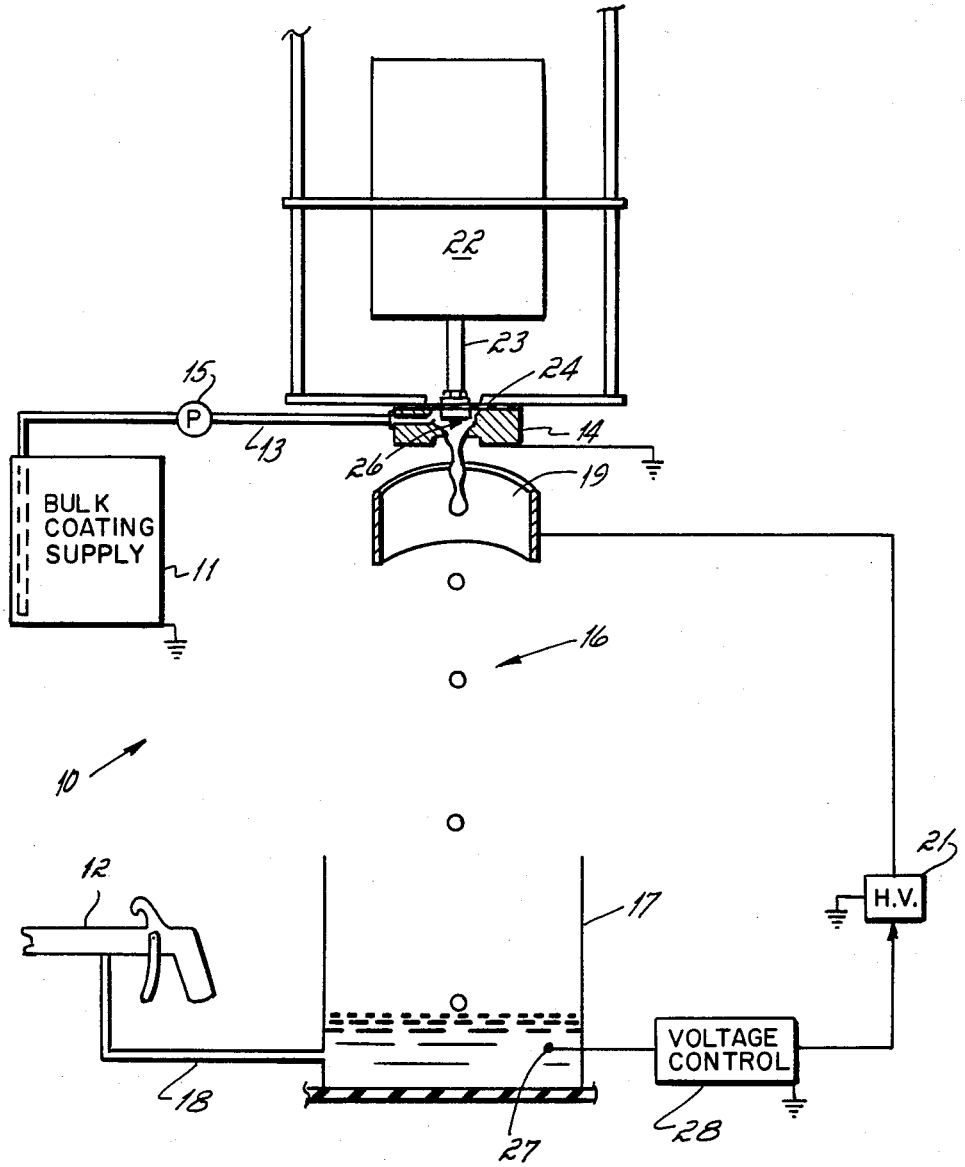
22
23
24
15
P
13
14
26
19
BULK
COATING
SUPPLY
11
16
10
12
17
21
H.V.
VOLTAGE
CONTROL
18
27
28

ELECTROSTATIC HIGH VOLTAGE ISOLATION SYSTEM WITH INTERNAL CHARGE GENERATION

DESCRIPTION OF THE INVENTION

This invention relates generally to electrostatic coating systems. The invention is disclosed particularly in relation to a spray coating system in which coating material supplied to a spray gun is electrostatically charged by inducing an electrostatic charge on discrete droplets of coating material transferred from a coating material source to a coating material supply for the spray gun.

In electrostatic coating systems, a coating material at a high electrostatic potential, such as, for example, 60 kilovolts, is applied to a grounded object which is to be coated. An illustrative electrostatic coating system is an electrostatic spray painting system such as for spray painting motor vehicle bodies or the like. In such systems, electrically grounded car bodies, or portions thereof, are moved past a spray painting station at which the highly charged paint is sprayed from a spray gun onto each car body. The paint sprayed onto the can bodies is often electrostatically charged by an electrode at the tip of the spray gun itself as the paint exits the gun.

In some spray coating systems, a conductive coating material may be used for electrostatically coating the workpieces. For example, in spray painting systems, water-based paints or paints containing a high metallic content may be used. In spray painting with electrically conductive paint, the paint is coupled to the gun in an insulated hose from a supply container which is electrically insulated from ground. This is necessary since the electrostatically charged paint emanating from the gun is electrically coupled through the conductive paint column in the hose to the paint in the supply container.

In dealing with electrically conductive paint in electrostatic spray painting systems, advantage has been taken of the conductive nature of the paint to, in some cases, move the charging electrode from a location at the gun to a location along the paint hose or at the paint supply container itself. The electrostatic potential applied at the paint container, or in the paint hose, is then coupled by the conductive paint to the gun so that the paint emanating from the gun nozzle is adequately electrostatically charged for electrostatic spray painting.

Regardless of the point in the coating system at which the high voltage supply is connected, the voltage requirements on the supply remain substantially the same, in order to produce the desired electrostatic potential on the paint emanating from the spray gun. This is because the charged conductive paint in the gun, hose and supply container must be commonly maintained at the electrostatic potential needed at the gun. There is an additional current loading requirement on the high voltage supply in a conductive paint system, beyond that imposed upon a gun electrode in a nonconductive paint system, due to the larger quantity of paint which must be maintained at the desired electrostatic potential and the increased leakage current associated therewith.

It is a general aim of the present invention to provide an electrostatic coating system of the foregoing type which utilizes a high voltage generator, for electrostatically charging a suitably conductive coating material, which is less costly than those heretofore used, and which operates at a voltage which is actually lower than the voltage to which the coating material is charged.

As shall be described herein with regard to a particular illustrated embodiment of the invention, this objective has been accomplished by transferring coating material to the coating material supply container for an electrostatic spray gun in the form of discrete droplets which are electrostatically charged before entering the container. A lower voltage supply can be used to charge each droplet, while the aggregate potential for the coating material coupled to the gun is at the requisite level for electrostatic spraying, a voltage level which is higher than that of the supply. The supply also draws very little current, theoretically no current at all. In this way the power requirement on the high voltage supply is substantially reduced. Since the high voltage supply operates at a lower voltage, the insulation requirements for the supply are also reduced.

In the illustrated form of the invention, the coating material is transferred from a grounded source of coating material into the gun supply container in the form of a pulsed jet droplet flow which has the additional advantage of isolating the charged paint container from the grounded source. In this way, a large bulk supply of coating material need not be elevated to the electrostatic potential of the coating material at the gun, avoiding the attendant safety problems of having a large, highly charged bulk supply. However, in this disclosed system, the gun may be operated on a continous basis since the system need not be shut down to transfer coating material into the charged paint container.

Other objects and advantages of the invention, and the manner of their implementation, will become apparent upon reading the following detailed description and upon reference to the single drawing FIGURE which illustrates in schematic form an electrostatic paint spray coating system in accordance with the present invention.

While the invention is susceptible to various modifications and alternative forms, a specific embodiment thereof has been shown by way of example in the drawing and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

With reference now to the drawing, an electrostatic spray coating system 10 for spraying electrically conductive paint onto grounded objects to be painted includes a bulk coating supply 11 of conductive paint which is coupled to a spray gun 12 for spraying onto workpieces (not shown). The conductive paint from the grounded bulk supply 11 is coupled through a conduit 13 to a grounded reservoir 14 by a pump 15 and transferred from the reservoir in the form of a pulsed jet droplet flow 16 into a gun supply container 17. The container 17 is electrically isolated from ground, and the paint in the container 17 is coupled through an insulated hose 18 to the spray gun 12 for application to workpieces to be painted. The paint may be pumped from the container 17 to the gun 12, or a pressurized housing (not shown) may be provided to enclose the reservoir 14, electrode 19 and container 17 to produce a pressurized flow of paint to the gun.

In the illustrated form of the invention, the droplets in the droplet stream 16 are subjected to an electrostatic field produced by an electrode ring 19 which is charged to a positive potential of, for example, 1 to 10 kilovolts by a high voltage supply 21. The electrostatic field is produced by the charging ring 19 at a location where droplets are formed below the reservoir 14. The electrostatic field induces a negative charge upon the droplets in the flow stream 16. The conductive paint in the supply container 17, which is made up of an accumulation of the charged droplets, is charged to a potential which is an aggregate of the charge induced on the individual droplets. This potential is of a magnitude considerably greater than that of the potential on the electrode 19. For example, the coating material in the container 17 may be charged to a potential of 60 kilovolts. This 60 kilovolt potential is coupled through the paint column in the hose 18 to the paint emanating from the spray gun 12.

The electrode 19 should be symmetric about the path of the droplet flow to avoid attraction of the charged droplets to the electrode. For example, instead of an electrode ring, the electrode 19 may take the form of a pair of plates on opposite sides of the flow path and equally spaced therefrom.

In order to form the droplet stream 16, the coating material pumped into the reservoir 14, which serves as a nozzle, is mechanically vibrated by a vibrator 22 acting through a piston 23 coupled to a membrane 24 forming one wall of the reservoir 14. The vibrator 22 drives the piston 23 and diaphragm 24 to produce uniform pressure variations in the paint reservoir which result in substantially uniform droplet formation at a short distance below a nozzle aperture 26 formed in the bottom of the reservoir 14. At the point where the droplets form, they are charged by induction by the electrode ring 19. The electrode attracts charges (of opposite polarity) on the grounded paint, and the induced charge remains on the droplets after they have formed. While the particular droplet forming technique is not critical to the practice of the invention, it is important that the electrostatic field produced by the electrode 19 be present during droplet formation. The pulsed jet droplet formation advantageously employed in the present system is described in more detail in our application filed on even date herewith and entitled "Electrostatic Isolation Apparatus and Method", which is incorporated herein by reference.

In order to control the electrostatic charge on the paint in the container 17, which is coupled to the gun 12, a voltage sensor 27 is positioned to measure the voltage of the paint in the container. This sensor is coupled to a voltage control 28 which in turn sets the output level of the high voltage generator 21 to set a suitable potential on the electrode ring 19. In this way, the droplets in the droplet stream 16 are charged to the requisite level to maintain the desired electrostatic potential for the paint supplied to the gun 12.

While the invention has been described with regard to conductive coating materials, it should be noted that the droplet charging technique may be utilized with less conductive coating materials as well. If, for example, non-conductive charged paint is supplied to the container 17, since the paint flow is from the container to the gun 12, the paint at the gun is electrostatically charged, regardless of the conductivity, or lack thereof, of the paint.

A practical limitation on the applicability of the disclosed system with less conductive coating materials is imposed by the ability to induce a suitable charge on the coating material droplets. In essence, the charging time necessary to induce a suitable charge on a droplet must be equal to or less than the amount of time that the paint spends in the electrostatic field prior to breakup. This charging time is defined by the conductivity of the coating material and the capacitance of the electrode-nozzle arrangement.

It is presently believed, for example, that coating materials having a resistivity on the order of $10^3$ ohm-centimeters, such as water-based paints, are ideally suited for use in the disclosed system. On the other hand, it is presently believed that very low conductivity coating materials, such as those having a resistivity of $10^9$ ohm-centimeters and above are probably unsuited for use in the disclosed system. For coating materials having resistivities in an intermediate range between these values, the suitability of the system would depend upon the system parameters such as the capacitance of the electrode-nozzle arrangement.

What is claimed is:

1. An electrostatic coating system comprising:

a source of coating material;

means for applying electrostatically charged coating material to objects to be coated;

a supply of coating material, electrically isolated from the source of coating material, coupled to the means for applying electrostatically charged coating material;

means for transferring coating material from the source of coating material to the supply of coating material by forming transferred coating material into discrete droplets; and means for inducing an electrostatic charge on the discrete droplets of transferred coating material to establish an electrostatic charge on coating material in the supply of coating material which is coupled by means of a fluid conduit to the means for applying electrostatically charged coating material.

2. The electrostatic spray coating system of claim 1 in which the means for transferring coating material comprises means for producing a pulsed jet droplet flow of coating material into the supply of coating material.

3. The electrostatic coating system of claim 2 in which the source of coating material comprises a coating material reservoir positioned above the supply of coating material and having a nozzle aperture in a bottom portion thereof, and the pulsed jet droplet flow emanates from the nozzle aperture.

4. The electrostatic coating system of claim 1 in which the means for inducing an electrostatic charge comprises a high voltage generator coupled to an electrode positioned at a droplet formation location of the transferred coating material.

5. The electrostatic coating system of claim 4 in which the high voltage supply imposes a voltage on the electrode which is lower than the electrostatic charge on the coating material in the supply of coating material which is coupled to the means for applying electrostatically charged coating material.

6. A method of applying electrostatically charged coating material to objects to be coated comprising the steps of:

transferring coating material from a source of coating material to a supply of coating material, which is electrically isolated from the source of coating material, by forming transferred coating material into discrete droplets;

inducing an electrostatic charge on the discrete droplets of transferred coating material to establish an electrostatic charge on coating material in the supply of coating material; and coupling the electrostatically charged coating material in the supply of coating material by means of a fluid conduit to a coating material dispenser for applying electrostatically charged coating material to objects to be coated.

7. An electrostatic spray coating system comprising:

a source of coating material including a grounded coating material reservoir having a nozzle aperture in a bottom portion thereof;

a spray gun for spraying electrostatically charged coating material onto objects to be coated;

a supply container having an opening in an upper portion thereof for coating material, which is electrically isolated from the coating material reservoir and from ground;

means for coupling coating material by means of a fluid conduit from the container to the spray gun;

means for transferring coating material from the reservoir to the container by producing a pulsed jet droplet flow of coating material from the nozzle aperture into the opening of the container; and means for inducing an electrostatic charge on droplets in the pulsed jet droplet flow of transferred coating material to establish an electrostatic charge on coating material in the container which is coupled to the spray gun.

* * * * *

UNITED STATES PATENT AND TRADEMARK OFFICE

CERTIFICATE OF CORRECTION

PATENT NO. : 4,544,570

DATED : October 1, 1985

INVENTOR(S) : Robert T. Plunkett et al.

It is certified that error appears in the above-identified patent and that said Letters Patent is hereby corrected as shown below:

The title page showing the illustrated figure should be deleted to appear as per attached title page.

Signed and Sealed this

*Thirtieth* Day of *September 1986*

[SEAL]

*Attest:*

DONALD J. QUIGG

*Attesting Officer*

*Commissioner of Patents and Trademarks*

United States Patent [19]

Plunkett et al.

[11] Patent Number: 4,544,570

[45] Date of Patent: Oct. 1, 1985

[54] ELECTROSTATIC HIGH VOLTAGE ISOLATION SYSTEM WITH INTERNAL CHARGE GENERATION

[75] Inventors: Robert T. Plunkett; Ion I. Inculet, both of London, Canada

[73] Assignee: Nordson Corporation, Amherst, Ohio

[21] Appl. No.: 574,286

[22] Filed: Jan. 26, 1984

[51] Int. Cl.[4] ..... B05D 1/04; B05B 5/02

[52] U.S. Cl. ..... 427/27; 118/621; 239/3; 239/690; 239/691

[58] Field of Search ..... 427/27; 118/621, 627; 239/3, 690, 691, 704–708

[56] References Cited

U.S. PATENT DOCUMENTS

| | | | |
|---|---|---|---|
| 2,673,232 | 3/1954 | Silsby, Jr. | 174/15 |
| 3,098,890 | 7/1963 | Peterson | 174/5 |
| 3,122,320 | 2/1964 | Beck et al. | 239/3 |
| 3,360,035 | 12/1957 | Van Loo et al. | 165/105 |
| 3,769,627 | 10/1973 | Stone . | |
| 3,892,357 | 7/1975 | Tamny . | |
| 3,893,620 | 7/1975 | Rokadia . | |
| 3,915,113 | 10/1975 | Paton | 118/625 |
| 3,929,286 | 12/1975 | Hastings et al. . | |
| 3,933,285 | 1/1976 | Wiggins . | |
| 3,934,055 | 1/1976 | Tamny . | |
| 3,971,337 | 7/1976 | Hastings . | |
| 4,017,029 | 4/1977 | Walberg . | |
| 4,020,866 | 5/1977 | Wiggins . | |
| 4,077,227 | 3/1978 | Larson . | |
| 4,085,892 | 4/1978 | Dalton . | |
| 4,097,680 | 6/1978 | Clavell, Jr. . | |
| 4,204,844 | 5/1980 | Pilat . | |

*Primary Examiner*—Richard Bueker
*Attorney, Agent, or Firm*—Wood, Herron & Evans

[57] ABSTRACT

An electrostatic high voltage isolation system with internal charge generation in which conductive coating material to be sprayed is electrostatically charged by charging discrete droplets of coating material transferred from a coating material source to a supply of coating material for a spray gun. The source of coating material includes an electrically grounded reservoir of coating material having a nozzle aperture in a bottom portion thereof, and the coating material in the reservoir is mechanically vibrated to produce a pulsed jet droplet flow of coating material from the nozzle into a supply container for the spray gun. A high voltage electrode at the location of droplet formation induces an electrostatic charge on the droplets in order to electrostatically charge the coating material transferred to the gun supply container for use by the gun for electrostatic coating.

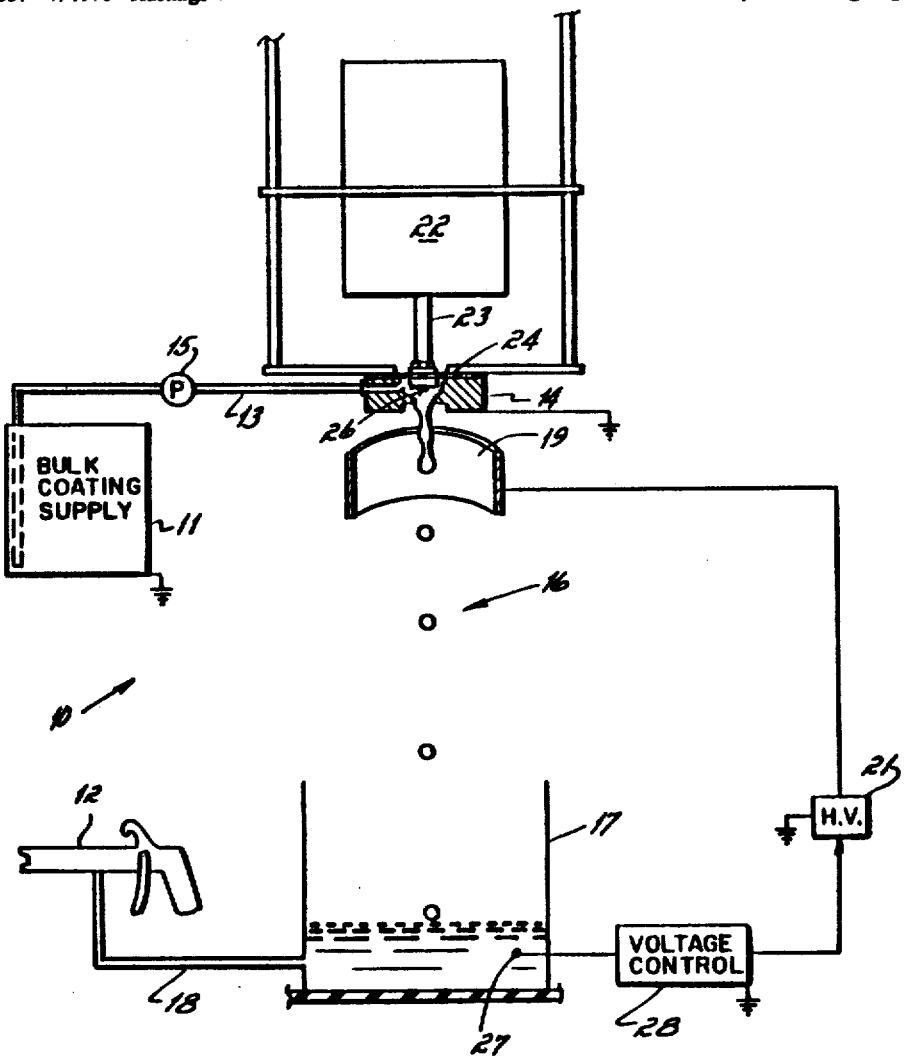

7 Claims, 1 Drawing Figure